United States Patent [19]

Campbell

[11] 4,174,096

[45] Nov. 13, 1979

[54] FENCE

[75] Inventor: David L. Campbell, Anchorage, Ak.

[73] Assignees: Richard G. Miller; Clifton W. Little, both of Houston; Alex Yovan, Alta Loma, all of Tex.; Charles M. Gause, Anchorage, Ak.; Don Harvey Campbell, Freeport, Tex.; Sam P. McManus, Houston, Tex.; David L. Weiler, Brookshire, Tex.; Clodis H. Cox, Katy, Tex.; Mable E. Weiler, Rapid City; Richard T. Weiler, Sterling Heights, both of Mich.

[21] Appl. No.: 803,880

[22] Filed: Jun. 6, 1977

[51] Int. Cl.[2] ..... E04H 17/16

[52] U.S. Cl. ..... 256/24; 256/26; 256/65; 256/73; 256/19

[58] Field of Search ..... 256/24, 29, 26, 65, 256/73; 52/585, 587

[56] References Cited

U.S. PATENT DOCUMENTS

| | | | |
|---|---|---|---|
| 2,441,364 | 5/1948 | Maynard | 52/587 X |
| 3,093,363 | 6/1963 | Bohon | 256/26 |
| 3,273,862 | 9/1966 | Miller | 256/24 X |
| 3,537,687 | 11/1970 | Adelman | 256/24 X |
| 3,801,072 | 4/1974 | Newberry, Jr. | 256/24 X |

*Primary Examiner*—Wayne L. Shedd
*Attorney, Agent, or Firm*—George M. Medwick

[57] ABSTRACT

A fence is characterized by interchangeably mountable fence sections each having a front and a rear surface, and parallel pairs of vertical and horizontal edges. A mounting member having a mast-receiving opening therein is disposed adjacent each vertical edge of the wall portion of each of the fence sections. Each mounting member has a mating surface thereon disposed in the same plane as the mating surface provided on the other mounting member. When the first mating surface on the wall portion of a first fence section is matingly engaged with a mating surface provided on the other of the mounting members on a next-adjacent fence section, the mast-receiving openings therein are disposed in vertical registration. The fence section, including the wall portions and the mounting members, are integrally fabricated of a plastic material.

25 Claims, 13 Drawing Figures

10
12
14
16
18
20
22
24
28A
28B
29
30A
30B
31
32A
32B
34A
34B
36A
36B
38A
38B
42A
42B
44A
44B
45
48

50
60
62
90
92
82
84
18
16
52
54A
54B
56A
56B
58A
58B
64
66
68
70
22
24
49
49A
14
28A
28B
32A
32B
34A
34B
36A
36B
38A
38B
42A
42B
44A
44B

FIG.7
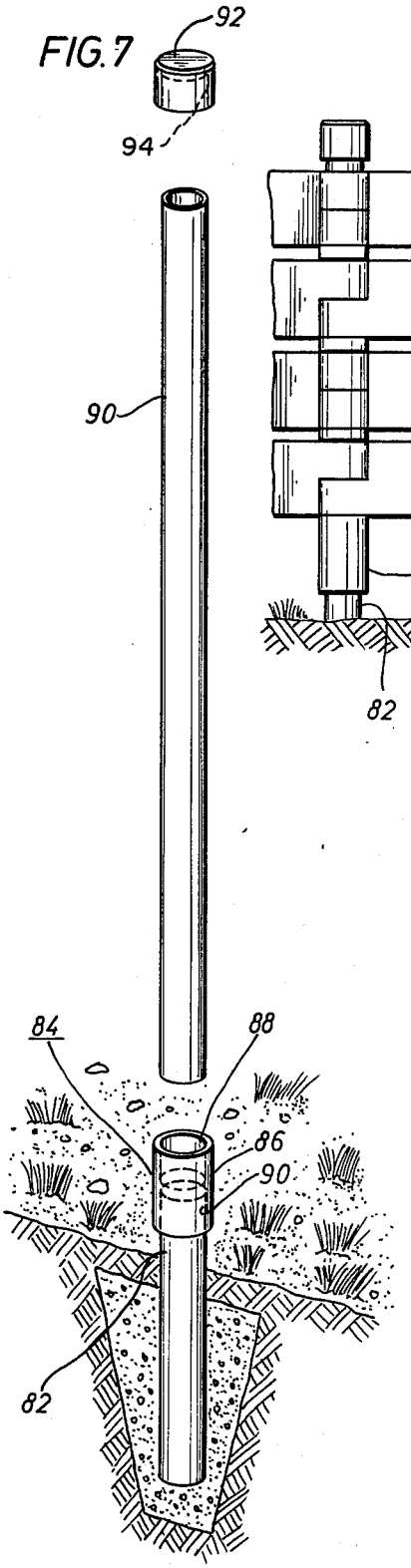
FIG.11
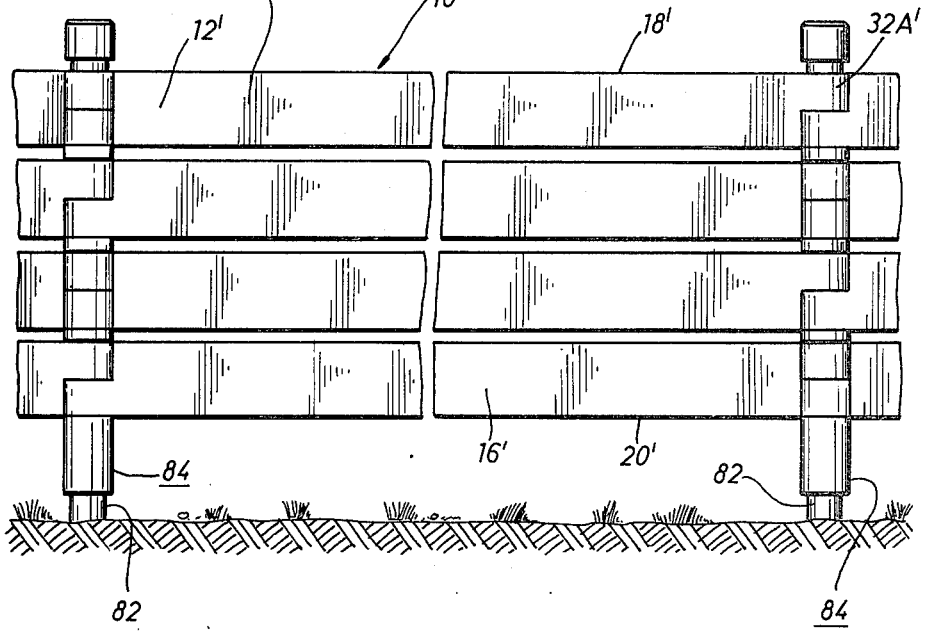
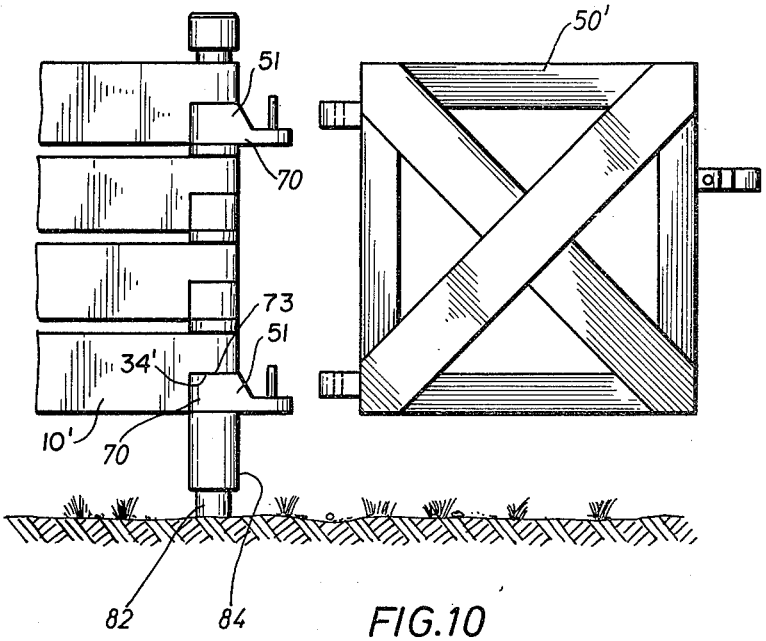
FIG.10

FIG.8
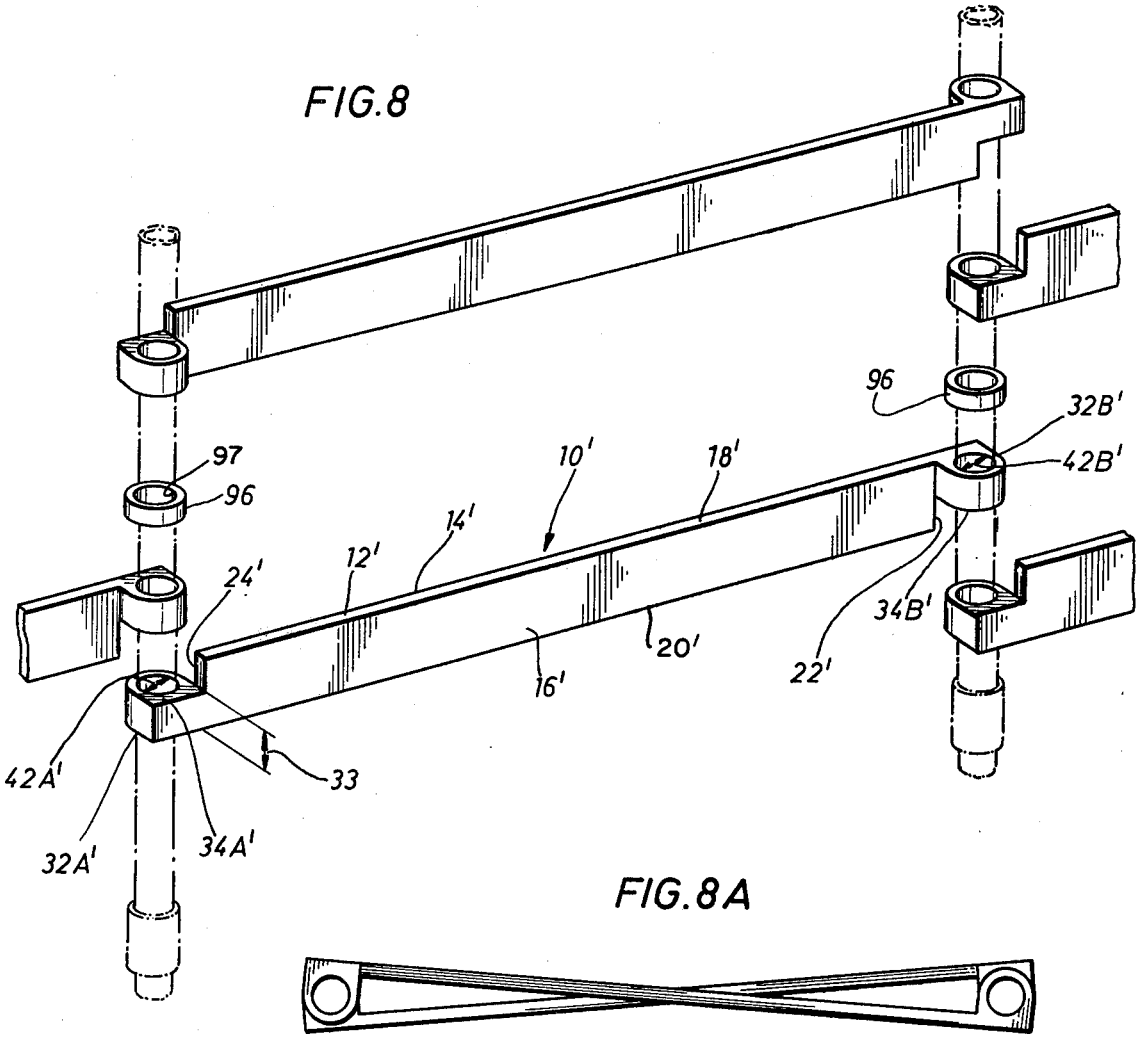
FIG.8A
FIG. 9B
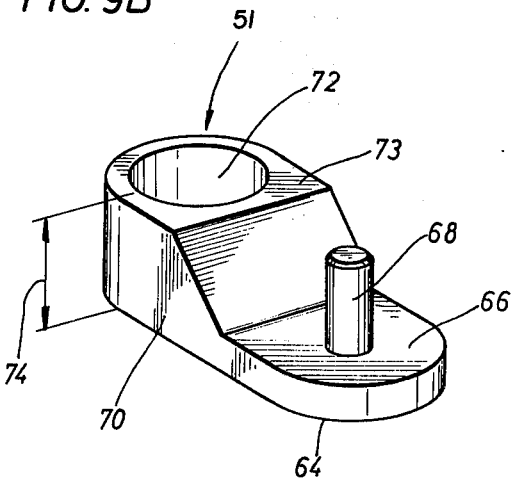
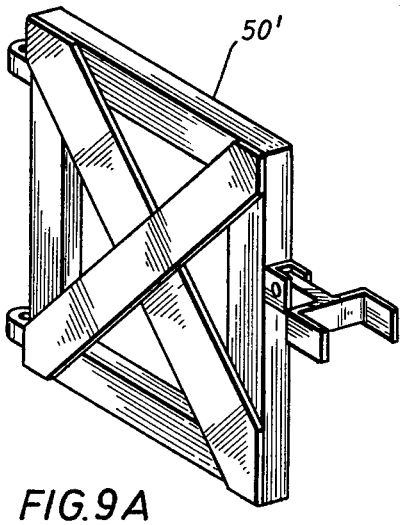
FIG.9A

FENCE

BACKGROUND OF THE INVENTION

1. Field of the Invention

This invention relates to fences, and in particular to an interchangeably mountable fence section for a privacy fence or for a rail fence.

2. Background of the Invention

To dispose a fence about the borders of one's real property, as a homesite, is advantageous for a variety of aesthetic, personal, and economic reasons. Economically, it enhances the value of the property; personally, it may be used to insure privacy and seclusion; and aesthetically, it adds a pleasing appearance effect to the property as a whole.

Two of the most popular fence arrangements are the privacy fence and the rail fence. Typically, to erect such fences, it is usually necessary for the landowner to contract for the services of skilled craftsmen, which is at best an expensive undertaking. Most landowners do not have the time, expertise, or materials to devote to the erection of fence arrangements.

Further, even when the fence has been erected, unless properly attended, the materials used in the fabrication of the fence deteriorate, splinter, corrode, or may otherwise become unsightly. The fence itself is also unable to be disassembled; and the constituent elements cannot be salvaged for reuse.

It would therefore be advantageous to provide a privacy or a rail fence that is easily able to be erected by the average landowner, in a minimum of time using for erection only a minimum of tools. It would be of further advantage to provide a fence that is light weight and easily handled during erection, and uses interchangeably mountable fence sections to facilitate the erection thereof. It is of even further advantage to provide a fence without any corrodible elements which tend to become unsightly. Still further, to provide a fencing arrangement that is easy to clean and maintain, and is able to be disassembled for further use would appear to be of advantage.

SUMMARY OF THE INVENTION

This invention relates to an interchangeably mountable fence section having a wall portion with a front and a rear surface, and parallel pairs of vertical and horizontal edges thereon. The invention provides a pair of mounting members, one of which is disposed adjacent each lateral edge of the wall portion. Each mounting member has a mating surface thereon lying in a common plane with the mating surface provided on the other of the mounting members. When the mating surface of one mounting member is matingly engaged with a mating surface of the other mounting member on a next-adjacent wall portion, the mast-receiving openings therein are disposed in vertical registration.

In one embodiment of the invention, particularly useful for a privacy fence, the mounting members having the mast-receiving openings therethrough are disposed adjacent only the rear surface of the wall portion. In another embodiment of the invention, particularly useful for a rail fence, a mounting member is provided adjacent the front surface of the wall portion while the second of the pair of mounting members is provided adjacent the rear surface thereof. In the former embodiment, the fence section is interchangeably mountable in that either of the horizontally extending edges may be disposed as the upper horizontal edge with the front surface always being disposed away from the area enclosed thereby. In the latter embodiment, the fence section is interchangeable and reversible in that either of the horizontal edges may be disposed as the upper horizontal edge, and either the front or the rear surface may be disposed away from the area enclosed by the fence.

The invention further includes a post comprising a stud member adaptable to be anchored in spaced adjacency from another stud along the perimeter of the area to be enclosed. A coupling having a separator therein defining first and second sockets is adapted to receive, in the first socket, the upper end of the stud and, in the second socket, the lower end of a vertically extending mast.

BRIEF DESCRIPTION OF THE DRAWINGS

The invention will be more fully understood from the following detailed description of a preferred embodiment thereof, taken in connection with the accompanying drawings, which form a portion of this specification, and in which:

FIG. 7 is an exploded view of a fence post embodying the teachings of this invention;

FIGS. 8 and 8A are, respectively, exploded perspective views of interchangeably and reversibly mountable rail fence sections embodying the teachings of this invention and a top view of at least a two-tiered rail fence erected therewith;

FIGS. 9A and 9B are, respectively, perspective views of a gate and hinge mount therefor adaptable for use with a rail fence erected with rail fence sections shown in FIG. 8;

FIG. 10 is an elevational view of a gate section shown in FIG. 9A just prior to its connection with a hinge mount shown in FIG. 9B disposed in rail fence utilizing rail fence sections embodying the teachings of this invention; and, FIG. 11 is an elevational view of a rail fence embodying the teachings of this invention.

DESCRIPTION OF THE PREFERRED EMBODIMENT

Figures 1, 2, 3:
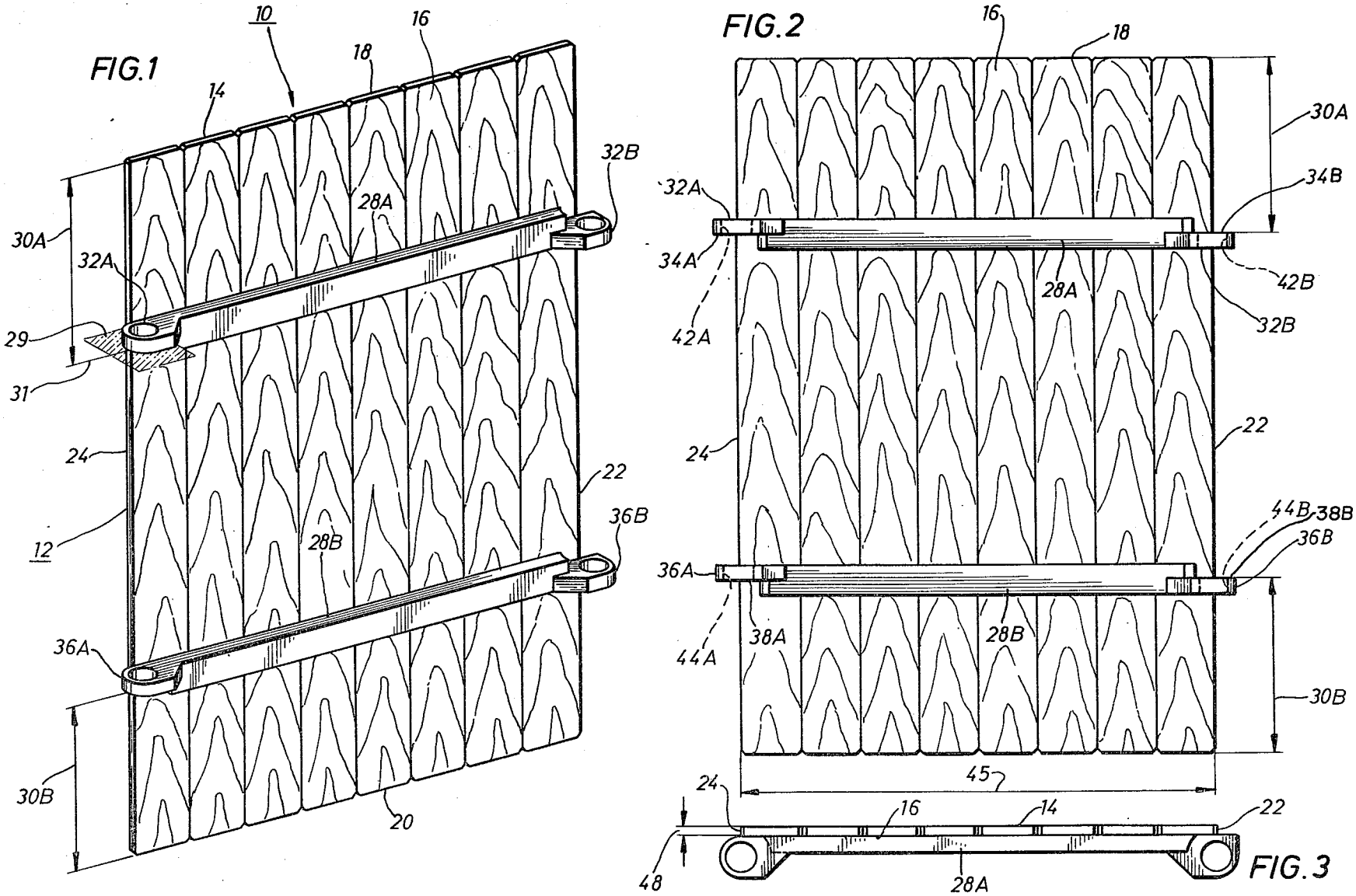
FIG. 1 is a perspective view of a interchangeably mountable straight-run fence section adapted for use in a privacy fence and embodying the teachings of this invention.
FIG. 2 is an elevational view of the fence section shown in perspective in FIG. 1.
FIG. 3 is a top view of a fence section shown in FIG. 2.

Throughout the following description similar reference numerals refer to similar elements in all figures of the drawings.

In FIGS. 1, 2 and 3 perspective, rear-elevational, and top views of a straight-run fence section embodying the teachings of this invention are shown. In FIGS. 1 through 3, the straight-run fence section indicated by reference numeral 10 is illustrated as comprising a substantially rectangular wall portion 12 having a front surface 14 and a rear surface 16 thereon. The wall portion defines upper and lower horizontally extending edges 18 and 20, respectively, and right and left vertically extending edges 22 and 24, respectively. The fence section is adapted for interchangeable mounting on an upstanding mast (as discussed herein). By "interchangeable", it is meant that the straight-run fence section 10 shown in FIGS. 1 through 3 embodying the teachings of this invention is mountable on an upstanding post such that the outer or front surface 14 is at all times presented away from the area to be enclosed and the rear surface 16 is at all times presented toward the area to be enclosed, but that either of the horizontally extending edges 18 or 20 may be the "upper" horizontal edge while either of the vertical edges 22 or 24 may be the "right-hand" edge, dependent upon the disposition of the next-adjacent straight-run fence section utilized during erection of the fencing arrangement.

To facilitate the interchangeability described above, a straight-run fence section embodying the teachings of this invention has at least one pair of mounting members, comprising a first and a second mounting member, one mounting member being respectively disposed on the wall portion 12 adjacent the first, right edge 22 and the second mounting member being disposed adjacent the second or left edge 24. The mounting members, as is discussed more fully herein, are each provided with a mast-receiving opening extending therethrough and are also provided with mating surfaces thereon. It is a feature of this invention that the mating surfaces on each mounting member in each associated pair of mounting members lie in a common plane. The mating surface on a first mounting member is adapted to matingly engage with the mating surface on a second mounting member of a next-adjacent fence section such that the mast-receiving openings in the mated first and second mounting members vertically register. Those skilled in the art would appreciate that a fence section embodying the teachings of this invention and disposing pairs of mounting members having the mating surfaces thereof disposed in a common plane may utilize wall portions thereof any predetermined surface shape. For example, the wall portion may be cylindrical, angulated, or rectilinearly planer (as particularly illustrated in FIGS. 1 through 3) and remain within the teachings of this invention.

The specific embodiment of this a straight-run fence section embodying the teachings of this invention as shown in FIGS. 1 through 3 utilizes first and second back stops, or backbars, 28A and 28B. Each backbar extends across the rear surface 16. Each backbar 28 has a bisecting plane 29 (FIG. 1) which is adapted to bisect each backbar 28 into equal portions. The bisecting planes of each of the backbars 28 are parallel with each other and with the upper edge 18 of the fence section 10. Furthermore, each bisecting plane and, therefore, each backbar 28, is disposed a predetermined vertical distance 30 from the closest horizontally extending edge of the fence section 10. With reference to the Figures, it may be appreciated that the bisecting plane associated with the backbar 28A is spaced a predetermined vertical distance 30A from the top surface 18 with which it is next-adjacent. Similarly, the backbar 28B and the bisecting plane associated therewith is disposed a predetermined vertically extending distance 30B, equal in magnitude to the distance 30A, from the second horizontally extending edge 20 with which it is next-adjacent. Such equalarity of distances 30 is required for the interchangeability of the straight-run fence sections exhibiting two pairs of mounting members, as is discussed herein. In the case of the single pair of mounting members, it is required that the commonalty of mating surfaces with respect to a common plane be maintained. However, it is advantageous in such constructions to locate that common plane equidistant from each horizontally extending edge.

Referring again to FIGS. 1 through 3, each backbar 28 has a medial axis 31 contained within the bisecting plane 29. Extending axially, with respect to the medial axis, from each end of each backbar 28 are first and second mounting members, or flanges 32 and 36, respectively extending from the backbars 28A and 28B.

The pair of mounting flanges 32 are disposed on the backbar 28 such that the mounting flange 32A extends axially from the backbar 28A (adjacent the edge 24 of the wall portion 12) and has a mating surface 34A thereon disposed above the medial axis and bisecting plane of the backbar 28A. The mounting flange 32B extending axially from the opposite end of the backbar 28A (adjacent the edge 22 of the wall portion 12) has a mating surface 34B thereon disposed below the medial axis and bisecting plane of the backbar 28A. The second backbar 28B and the flanges 36 extending axially therefrom also provide mounting surfaces 38A and 38B thereon. In the case of the mounting flange 36A, the mating surface 38A thereof is also disposed above the medial axis and bisecting plane of the backbar 28B while the mating surface 38B on the mounting flange 36B is disposed below the medial axis and bisecting plane of the second backbar 28B. The flange 32A and the flange 36A extend from corresponding axial ends of the backbars 28A and 28B, respectively, while the flange 32B and the flange 36B extend from corresponding axial ends of the backbars 28A and 28B, respectively.

Stated in another way, as seen in the Figures, fence sections embodying the teachings of this invention are disposed so that the mounting flange 32B whose mating surface 34B is below the medial axis and bisecting plane of the first backbar 28A is adjacent the vertical edge 22 of the wall portion 12 to which is adjacent the mounting flange 36B whose mating surface 38B is disposed below the medial axis and bisecting plane of the second backbar 28B. Similarly, disposed adjacent the second vertical edge 24 of the wall portion 12 are the flanges 32A and 36A whose mating surfaces 34A and 38A are, respectively, disposed above the medial axis and bisecting plane of the first and second backbars 28A and 28B.

In the embodiment of the invention shown in FIGS. 1 through 3, it may be appreciated that the mating surfaces 34 and 38 disposed respectively on the mounting members or flanges 32 and 36 are in the same common plane, namely the bisecting plane extending through the respective backbars 28 with which the mounting flanges are associated. Furthermore, in order to provide interchangeability of a fence section shown in FIGS. 1 through 3, it is necessary to dispose the bisecting planes (and accordingly, the mating surfaces) the predetermined vertical spacing 30 between the bisecting planes and the adjacent horizontal edges.

Each of the mounting members 32 has a mast-receiving opening 42 extending therethrough, the central axes of the openings 42 extending substantially parallel to the vertically extending edges 22 and 24 of the wall portion 12. Similarly, mast-receiving openings 44 are disposed within the mounting flanges 36 such that the central axes of the openings 44 are parallel to the vertical edges of the wall portion 12. The axes of the openings 42 and 44 provided in the flanges 32 and 36, respectively, are spaced horizontally a predetermined distance 45 apart. As is discussed more fully herein, when the mounting surfaces of mountng members disposed adjacent one vertical edge of a wall portion of a fence section are matingly engaged with the mating surfaces of the others of the mounting flanges provided adjacent the other of the vertical edges of a next-adjacent wall portion of a fence section, the mast-receiving openings in the mounting members on both the fence section under consideration and the fence section next-adjacent thereto are in vertical registration and adapted to receive a substantially elongated mast member.

In the emodiment of the invention shown in FIGS. 1 through 3, it may be appreciated that the horizontal dimension of the wall portion 12 is provided such that the right end 22 thereof is coincident with the axes central of the openings 42B and 44B while the opposite edge 24 of the wall portion 12 is coincident with the axes central of the openings 42A and 44A. That is, the horizontal width of the fence section is equal to the distance 45. Thus, when the appropriate openings in the flanges on adjacent straight-run fence sections are registered in a mated relationship, the right vertical edge 22 of the first straight-run fence section is abutted against the left vertical edge 24 of the next-adjacent staight-run fence section.

Figures 4, 5, 6:
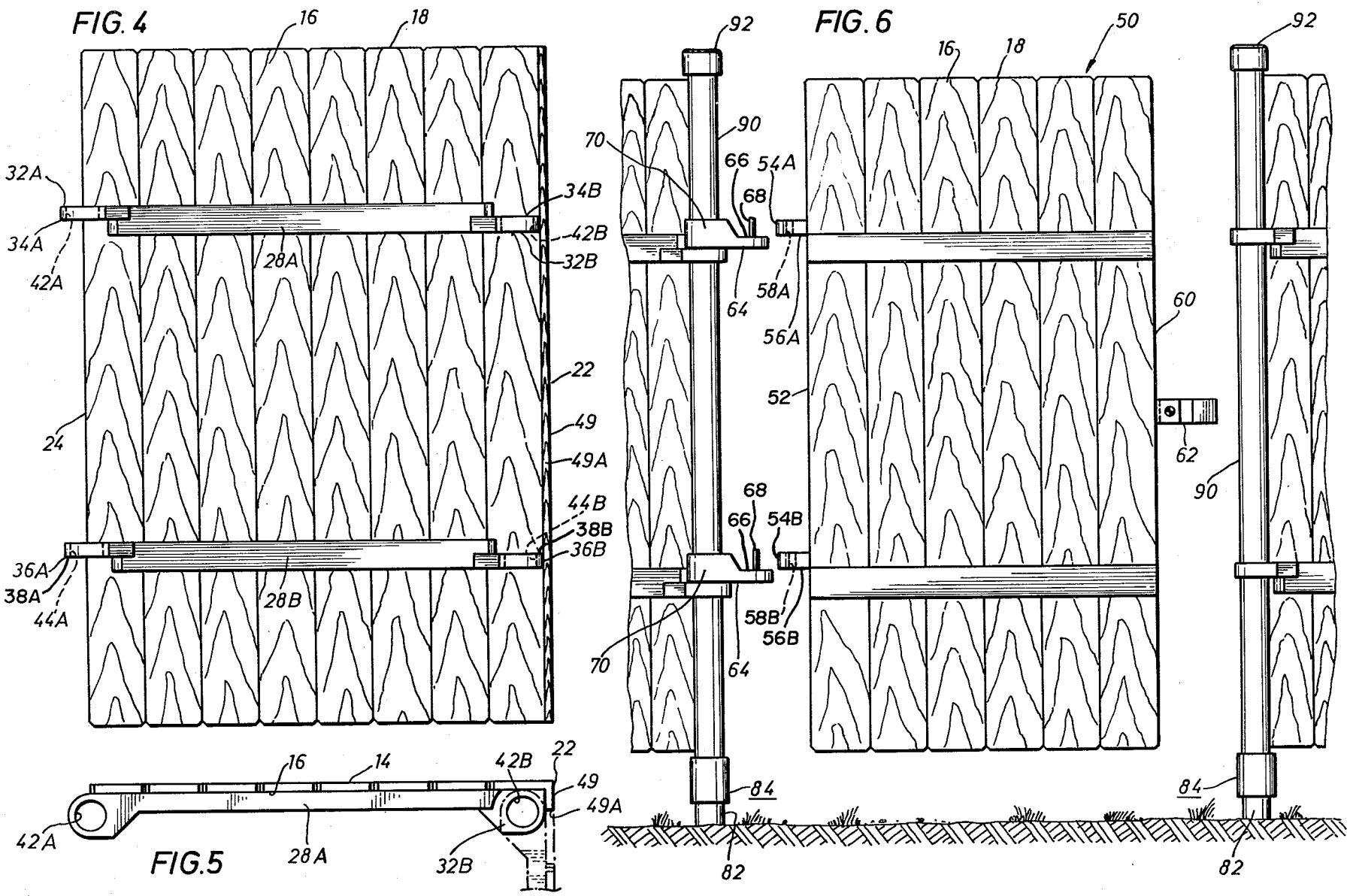
FIG. 4 is a view similar to FIG. 2 showing a corner fence section adapted for use in a privacy fence.
FIG. 5 is a top view, similar to FIG. 3, of the fence section shown in FIG. 4.
FIG. 6 is an exploded view of a gate and hinge mount therefore adaptable for use with a privacy fence fabricated of straight-run and corner fence sections shown in FIGS. 1 through 5.

With particular reference to FIGS. 4 and 5, a corner fence section is shown. In this fence section, the right edge 22 of the wall portion 12 has a flap 49 which extends substantially perpendicular to the wall portion 12. The vertical edge 49A of the flap 49 is coincident with the axes central of the openings 42B and 44B extending through the flanges 32B and 36B in the backbars. Thus, the flap 49 wraps around the axial ends of the flanges 32B and 36B. The left edge 24 of the wall portion 12 of the corner fence section is coincident with the axes central of the openings 42A and 44A through the flanges 32A and 36A adjacent that edge 24. The mating surfaces 34 and 38 of the backbars 28 on the corner section are disposed as on the straight-run section, so that the corner section is "interchangeable", as defined above. The corner is advantageously used at 90° turns in the fence.

The corner fence section shown in FIGS. 4 and 5 are used in cooperative association one with another at each point along the perimeter of the area to be enclosed which defines an angular distance between the rear surfaces 16 of adjacent fence sections of an angular amount other than 0° or 180°, that is, at any "corner". It is advantageous for complete obstruction of the view into the enclosed area at such points. The free flanges of each corner section are, as stated, interchangeably engageable with straight-run fence section shown in FIGS. 1 through 3.

In accordance with the teachings of this invention, each corner fence section and straight-run fence section is fabricated integrally with the backbars and mounting flanges associated therewith from a strong, durable, easy-to-clean plastic foam material. The fence sections may be expeditiously fabricated by molding and may, therefore, provide an attractive and easy-to-maintain fence section. The colors provided will not fade or attenuate due to weather, and no corrodible attachments, as nails or the like, are utilized. The fence sections are lightweight, easy to handle during erection, and, as discussed herein, easy to assemble and to disassemble. Because of limitations attendant upon the fracturing and splintering qualities thereof, wood is not readily adaptable for use in fabricating fence sections embodying these teachings. Furthermore, wood and metal are too weighty and provide a fence section which is not easily handled as is a fence section molded from a plastic material.

Referring to FIG. 6, an exploded view of a fence gate section 50 and a hinge mount member 51 (see also FIG. 9B) associated therewith is shown. The gate section 50 is fabricated of plastic material and molded as the case of the corner or straight-run fence sections and has provided axially extending mounting flanges 54A and 54B from one vertically extending edge 52 thereof. Each flange 54 has a mating surface 56 with a hinge post receiving opening 58 therein. The opposite vertical edge 60 of the gate section 50 is provided with a suitable locking latch 62. All parts above-described are integrally fabricated with the gate section.

The hinge mount 51 includes a flange portion 64 having a mating surface 66 adapted to mate against the mating surface 56 provided on a mounting flange of an associated gate section. A hinge post 68 projects substantially upwardly from the mating surface 66 of the hinge mount 51. Integrally provided with the flange portion 64 is a thickened portion 70 having a mast-receiving opening 72 therethrough. The mast-receiving opening extends through a mating surface 73 and is, as made clear herein, adpated to receive a mast of a mounting post utilized in connection with the fence embodying the teachings of this invention. Typically, the height dimension 74 of the hinge mount 51 is of a predetermined dimension which, for reasons explained herein, is equal to one-half the height in dimension of the rail fence section of FIG. 8.

FIG. 7 is an exploded view of a fence post utilized in connection with fencing sections described herein above. The fence post includes a hollow cylindrical stud, or spud, 82 adaptable for anchoring within a suitable post hole, as is discussed herein. A substantially cylindrical coupling member 84 having a separator portion 86 therein defining first and second sockets 88 and 90, respectively. The coupling is disposed so that the lower or second socket 90 receives the upper vertical end of the stud 82. An elongated hollow cylindrical mast 90 of a predetermined length dimension dependent upon the height dimension of the fence section being erected is adapted to be received at its lower vertical end into the first socket 88 of the coupling. A cap piece 92 has a socket 94 defined therein and is adapted to cover the upper vertical end of the mast 90. It is appreciated that the cross sectional shape of the mast 90 conforms with the cross sectional shape of the mast-receiving openings 42 and 44 (FIGS. 1 through 5) provided on the corner or straight-run fence section. It is also appreciated that the cross sectional shape of the stud 82 need not conform with the cross sectional shape of the mast 90 due to the provision of the coupling 84. However, in order to increase the flexibility of the fencing arrangement here disclosed, it is preferred that similar cross sectional shapes of the stud 82 and the mast 90 conform with the cross sectional shape of the mast-receiving openings on the fence sections and hinge mount. Any suitable plastic cement or the like may be used to securely engage the post elements. Further, the post elements may be made more sturdy by disposing a filling of cement or rocks or the like therein. The fence post elements are colored in the same coloration as the fence sections, so that if angles other than 0°, 90° and 180° occur between adjacent straight-run sections and expose the posts, privacy is still maintained and no color discontinuity occurs.

Having thus described the structural elements of a fencing arrangement embodying the teachings of this invention, the method of installation of a fence utilizing the fencing sections shown in FIG. 1 through 5 is next discussed.

If it is desired to enclose a predetermined area with a privacy fence, it is first necessary to locate the studs 82 at predetermined distances from each other. It is appreciated that the predetermined distances between the axes of the studs 82 is equal to the predetermined distance 45 between the axes of the mast-receiving openings provided in any associated pair of mounting flanges disposed on the fencing sections. After the studs 82 are secured by any convenient means at their appropriate positions, they are cut so as to receive the socket 90 of the coupling 84 thereon. The saw or the like used to cut the studs 82 is the only tool necessary (other than a shovel if the post holes are provided) to erect a fence embodying the teachings of this invention. The studs 82 are severed such that when the coupling 84 is mounted on the upper end thereof, the vertical distance between the topmost edge of the coupling 84 and the ground is equal to at least the predetermined distance 30B between the bisecting plane through the lower backbar 28B and the lower horizontal edge 20 of the fence section plus a predetermined ground-clearance distance. After the studs and coupling have been set in place, beginning at a corner of the area to be enclosed, two corner sections are brought together such that the mating surfaces 34A and 38A on the first corner section are matingly engaged with the mating surfaces 34B and 38B on the second corner section so that the mast-receiving openings 42 and 44 provided in each mounting flange are in vertical registration. With this accomplished a mast is extended between the registered openings and inserted into the upper socket 88 of the coupling. A cap 92 may be provided.

Once the corner has been erected, the "free" flanges along the other vertical edge of the erected sections are then brought into mating engagement with corresponding other flanges of the next-adjacent fence section to be erected and the openings therein placed in vertical registration. Since the studs and coupling 84 have been previously aligned and spaced distances equal to the width dimension 45 between axes of the mast-receiving openings, once vertical registry of the openings is effected it is necessary only to insert a mast 90 therethrough and into the upper socket 88 provided in the coupling. If the angularity between the adjacent fence sections is 0° or 180° (that is, a straight-run) it is necessary only to use straight-run sections shown in FIGS. 1 through 3. As discussed above, if any angularity other than 0° or 180° is effected, it is necessary that two corner sections shown in FIGS. 4 and 5 be used. In this manner, a privacy fence utilizing the straight-run and corner fence sections shown in the FIGS. 1 through 5 may be expeditiously erected.

When approaching a gated area, either corner section or straight-run section may be utilized. In this case, mounting hinges 51 (FIG. 6) are provided on the exposed flanges of the fence section in vertical registry with the mast-receiving openings therein, and a mast lowered through the registered openings and inserted into the appropriate socket 88 of the coupling. The hinge post receiving openings 58 on the gate 50 is then lowered on to the hinge posts 68 provided on the hinge amounts 51. Suitable caps may, of course, be provided on the hinge posts after the gate flanges are lowered thereon.

Referring now to FIG. 8, an isolated prospective view of a rail fence section embodying the teachings of this invention is illustrated. In FIG. 8 the rail fence section generally indicated by reference numeral 10' has a wall portion 12' including a front facing surface 14' and a rear surface 16'. The wall portion is defined by substantially parallel extending horizontal surfaces 18' and 20' and substantially vertically extending surfaces 22' and 24'.

The wall portion 12 has a medial axis and a bisecting plane extending therethrough and projecting axially from axial end of the fence section 10' are mounting members 32A' and 32B'. Of necessity due to their relationship with the bisecting plane, it is appreciated that the vertical dimension 33 of each of the mounting members 32' equals one-half the height dimension along the vertically extending edges 22' or 24' of the fence section 10'. The mounting member 32' have mating surfaces 34A' and 34B' disposed in the common bisecting plane. Mast-receiving openings 42A' and 42B' are provided through the mounting members 32'. In distinction to the fence sections shown in FIGS. 1 through 5, the mast-receiving openings 42' of the fence section shown in FIG. 8 are located adjacent opposite surfaces of the fence section 10'. That is to say, mast-receiving opening 42A' is disposed adjacent the facing surface 14', while the mast-receiving opening 32B' is disposed adjacent the rear surface 16'. In the case of the fence section 10 shown in FIGS. 1 through 5, the mast-receiving openings 42 and 44 are disposed adjacent the rear surface 16 thereof, presenting a completely integral facing surface 14. It is noted that the axes of the mast-receiving openings 42' are substantially parallel to their adjacent vertical edges 22' or 24'.

Referring again to FIG. 8, it may be appreciated that the fence station 10' there shown is also interchangeably mountable, as that term is used above. Further, the rail fence section shown in FIG. 8 is "reversible" in that either of the horizontally extending edges 18' or 20' may be the upper horizontal edge of the fence section, either of the vertical edges 22' or 24' may be left hand edge, and either of the faces 14' or 16' may be disposed to face toward the area to be enclosed. Thus, a rail fence section shown in FIG. 8 is totally interchangeable and completely reversible.

Referring momentarily to FIG. 9A, a view of a gate 50' suitable for use with a fence fabricated of rail sections described in connection with FIG. 8 is shown. The gate 50' is substantially similar in structure to the gate shown in FIG. 6 and provides flanges having hinge post-receiving openings therein along one vertical edge thereof.

Having described the structure of a rail fence section embodying the teachings of this invention a method of erecting the same may now be discussed. Again, the studs are set, and the couplings provided such that a predetermined distance between the top of the coupling and the ground is provided between the lower edge 20' of the lowermost horizontal tier of rail sections. Such clearance distances are within the discretion of the erector. In the case of the rail fence, however, it is necessary to start at a gate or corner location and to fully erect the post (with the exclusion of the cap 92).

When erecting a rail fence, in contradistinction to the mode of proceeding described in connection with the privacy fence, tiers of railing are erected sequentially as opposed to adjacent panels of fencing being erected sequentially. The erection may start from either a gate or corner location. Since there are no corner sections involved with a rail fence as in the case of the privacy fence, with reference to FIG. 10, starting from a gate location, it is first necessary to lower a hinge amount 51 such that the lower surface thereof abuts against the upper surface of the coupling 84. It is noted that the dimension 74 of the hinge mount 51 equals the height dimension 33 of a mounting flange 32' disposed at each end of the fence section 10'. Having provided the hinge mount, it is then necessary to lower a fence section 10' thereon such that the mating surface 34' provided on the mounting member 32' is matingly engaged with the mating surface 73 provided on the hinge mount. Since the hinge mount is lowered onto the coupling first, it is appreciated that mating surface 34A' on mounting member 32A' must be brought into mating engagement with the surface 73.

Continued erection of the tier is then facilitated by lowering on the next-adjacent mast 90 a second fencing section 10' such that the other of the mating surfaces 34 left exposed at the free end of the last-emplaced fence section 10' is mated with a corresponding mating surface. In this manner, a tier comprising conjoined rail sections may been provided. In order to space the tier in position from the next vertically disposed tier, a cylindrical spacer shown in perspective in FIG. 8 and illustrated by reference numeral 96 and having a mast-receiving opening 97 therein is provided. Again starting from the gate location, a second tier of rail sections is disposed in an alternating configuration so as to create the "X"-shaped fence arrangement illustrated from the top view shown in FIG. 8A.

Having described preferred embodiments of the structural elements embodying the teachings of this invention, it is understood that those skilled in the art may effect modifications thereto in view of the teachings hereof without departing from the scope of the invention as set forth in the appended claims.

What is claimed is:

1. A rail fence section adapted for interchangeable mounting on an upstanding mast comprising:

a wall portion having a front and a rear surface, a first and a second horizontal edge, and a first and a second vertical edge;

a first and a second mounting member respectively disposed adjacent said first and second vertical edges of said wall portion, each mounting member having a mast-receiving opening extending therethrough, each mounting member having a mating surface thereon, said mating surfaces being disposed in a common plane, each mounting member being connected to said wall portion such that said first mast-receiving opening is disposed adjacent said front surface of said wall portion and said second mast-receiving opening is disposed adjacent said rear surface of said wall portion;

said mating surface on said first mounting member adapted to matingly engage against a mating surface on a second mounting member of a next-adjacent fence section such that said opening in said first mounting member vertically registers with an opening extending through the second mounting member on the next-adjacent fence section and such that the mounting members on each adjacent fence section are obscured when viewed from both the front and rear.

2. A fence section according to claim 1 wherein said wall portion and said mast-receiving members integral with each other and are fabricated of plastic.

3. A fence section according to claim 1 wherein said wall portion and said mast-receiving members are integral with each other and fabricated of plastic.

4. A fence section according to claim 1, wherein each of said mounting members has a vertical dimension equal to one-half of the height of said vertical edges of said wall portion.

5. A fence section adapted for interchangeable mounting on an upstanding mast comprising:

a wall portion having a front and a rear surface and first and second horizontal edges and first and second vertical edges thereon;

first and second backbars mounted on said rear surface of said wall portion, each backbar having a bisecting plane therethrough, said bisecting planes being in parallel relationship with each other, said bisecting plane through said first backbar and said bisecting plane through said second backbar each being disposed a predetermined distance from the horizontal edge of the wall portion in adjacency thereto;

said first and second backbars each having a flange extending axially from each axial end thereof, one of said flanges extending from each of said backbars being disposed above said bisecting plane through said backbar, the other of said flanges extending from each of said backbars being disposed below said bisecting plane through said backbar;

said flanges disposed above said bisecting plane through said first backbar and said second backbar extending axially from corresponding ends of said backbars;

said flanges disposed below said bisecting plane through said first backbar and said second backbar extending axially from corresponding ends of said backbars; and each of said flanges having an opening therein, each of said openings having an axis therethrough perpendicular to said bisecting planes through said backbars, said openings in said flanges extending axially from respective ends of said backbars being in vertical registration.

6. A fence section according to claim 5 wherein said first and said second vertical edges of said wall portion are respectively coincident with said axes extending through said flanges extending axially from said respective ends of said backbars.

7. A fence section according to claim 5 wherein said wall portion and said backbars are fabricated from a plastic material and wherein said backbars are integral with said wall portion.

8. A fence section according to claim 6 wherein said wall portion and said backbars are fabricated from a plastic material and wherein said backbars are integral with said wall portion.

9. A fence section according to claim 5, wherein a flap is disposed along one vertical edge of said wall portion, said flap extending perpendicular to said wall portion.

10. A fence section according to claim 9, wherein the vertical edge of said flap is coincident with the axis of said openings extending through said flanges.

11. A fence arrangement comprising:

an upstanding post;

a first and a second fence section each interchangeably mounted on said post, each of said first and said second fence sections comprising:

a wall portion having a front and a rear surface and first and second horizontal edges and first and second vertical edges thereon;

first and second backbars mounted on said rear surface of said wall portion, each backbar having a bisecting plane therethrough, said bisecting planes being in parallel relationship with each other, said bisecting plane through said first backbar and said bisecting plane through said second backbar each being disposed a predetermined distance from the horizontal edge of the wall portion in adjacency thereto;

said first and second backbars each having a flange extending axially from each axial end thereof, one of said flanges extending from each of said backbars being disposed above said bisecting plane through said backbar, the other of said flanges extending from each of said backbars being disposed below said bisecting plane through said backbar;

said flanges disposed above said bisecting plane through said first backbar and said second backbar extending axially from corresponding ends of said backbars;

said flanges disposed below said bisecting plane through said first backbar and said second backbar extending axially from corresponding ends of said backbars; and each of said flanges having an opening therein, each of said openings having an axis therethrough perpendicular to said bisecting planes through said backbars, said openings in said flanges extending axially from respective ends of said backbars being in vertical registration.

12. A fence arrangement according to claim 11 wherein said first and said second vertical edges of said wall portion of each of said first and second fence sections are respectively coincident with said axes extending through said flanges extending axially from said respective ends of said backbars.

13. A fence arrangement according to claim 11 wherein said wall portion and said backbars of each of said first and second fence sections are fabricated from a plastic material and wherein said backbars are integral with each of said wall portions.

14. A fence arrangement according to claim 12 wherein said wall portion and said backbars of each of said first and second fence sections are fabricated from a plastic material and wherein said backbars are integral with each of said wall portions.

15. A fence arrangement according to claim 11 wherein a flap is disposed along one vertical edge of said wall portion of one of said fence sections, said flap extending perpendicular to said wall portion.

16. A fence arrangement according to claim 15 wherein the vertical edge of said flap is coincident with the axis of said openings extending through said flanges of the fence section with which said flap is associated.

17. A fence arrangement according to claim 11 wherein said upstanding post comprises:

an anchor stud insertable into a post hole such that when inserted an upper vertical end thereof is presented;

a coupling member having an upper and a lower socket therein, said lower socket being sized to receive said upper vertical end of said anchor stud, said upper socket having a cross-sectional shape corresponding to said openings in said flanges;

an elongated mast having an upper and lower end thereon, said mast having a cross-sectional shape corresponding to the cross-sectional shape of said openings in said flanges and said upper socket in said coupling member;

said mast being insertable between said first and second fence sections through said registered openings in said flanges and into said upper socket in said coupling member such that when inserted said mast supports said first and second fence sections in next adjacency to each other.

18. A fence arrangement comprising:

an upstanding post;

a first fence section comprising:

a wall portion having a front and a rear surface and first and second horizontal edges and first and second vertical edges thereon;

first and second backbars mounted on said rear surface of said wall portion, each backbar having a bisecting plane therethrough, said bisecting planes being in parallel relationship with each other, said bisecting plane through said first backbar and said bisecting plane through said second backbar each being disposed a predetermined distance from the horizontal edge of the wall portion in adjacency thereto;

said first and second backbars each having a flange extending axially from each axial end thereof, one of said flanges extending from each of said backbars being disposed above said bisecting plane through said backbar, the other of said flanges extending from each of said backbars being disposed below said bisecting plane through said backbar;

said flanges disposed above said bisecting plane through said first backbar and said second backbar extending axially from corresponding ends of said backbars;

said flanges disposed below said bisecting plane through said first backbar and said second backbar extending axially from corresponding ends of said backbars; and each of said flanges having an opening therein, each of said openings having an axis therethrough perpendicular to said bisecting planes through said backbars, said openings in said flanges extending axially from respective ends of said backbars being in vertical registration;

a first and a second hinge mount member each having a flange with a mating surface thereon and a hinge post extending therefrom, each of said hinge mount embers being receivable on said upstanding post with the mating surface of each hinge mount member being contacted against one of the flanges of said wall portion; and, a gate member swingably mounted on said hinge posts.

19. A rail fence arrangement comprising:

an upstanding post;

a first and a second fence section each interchangeably and reversibly mountable on said post, each of said first and said second fence sections comprising:

a wall portion having a front and a rear surface, a first and a second horizontal edge, and a first and a second vertical edge;

a first and a second mounting member respectively disposed adjacent said first and second vertical edges of said wall portion, each mounting member having a mast-receiving opening extending therethrough, each mounting member having a mating surface thereon, said mating surfaces being disposed in a common plane, said first mast-receiving opening being disposed adjacent said front surface of said wall portion and said second mast-receiving opening being disposed adjacent said rear surface of said wall portion;

said mating surface on said first mounting member of said first fence section being adapted to matingly engage against said second mating surface on said second mounting member of said second fence section disposed in next adjacency thereto such that said openings in said mounting members vertically register one with the other to define a first tier of fence wherein said mated mounting members are obscured when viewed from both the front and rear.

20. A fence arrangement according to claim 19 further comprising:

a third and fouth fence section each interchangeably and reversibly mountable on said post above said first and said second fence sections respectively, each of said third and said fourth fence sections comprising:

a wall portion having a front and a rear surface, a first and a second horizontal edge, and a first and a second vertical edge;

a first and a second mounting member respectively disposed adjacent said first and second vertical edges of said wall portion, each mounting member having a mast-receiving opening extending therethrough, each mounting member having a mating surface thereon, said mating surfaces being disposed in a common plane, said first mast-receiving opening being disposed adjacent said front surface of said wall portion and said second mast-receiving opening being disposed adjacent said rear surface of said wall portion;

said mating surface on said first mounting members of said fourth fence section being adapted to matingly engage against said second mating surface on said second mounting member of said third fence section disposed in next adjacency thereto such that said openings in said mounting members vertically register one with the other to define a second tier of fence disposed above said first tier of fence wherein said mated mounting members are obscured when viewed from both the front and rear and wherein said first and third fence sections and said second and fourth fence sections cross the other to define an X pattern when viewed from above said first and second tiers.

21. A fence arrangement according to claim 19 wherein said upstanding post comprises:

an anchor stud insertable into a post hole such that when inserted an upper vertical end thereof is presented;

a coupling member having an upper and a lower socket therein, said lower socket being sized to receive said upper vertical end of said anchor stud, said upper socket having a cross-sectional shape corresponding to said openings in said mounting members;

an elongated mast having an upper and lower end thereon, said mast having a cross-sectional shape corresponding to the cross-sectional shape of said openings in said mounting members and said upper socket in said coupling member;

said mast being insertable between said first and second fence sections through said registered openings in said mounting members thereof and into said upper socket in said coupling member to thereby support said first and second fence sections in next adjacency to each other.

22. A fence arrangement according to claim 20 wherein said upstanding post comprises:

an anchor stud insertable into a post hole such that when inserted an upper vertical end thereof is presented;

a coupling member having an upper and a lower socket therein, said lower socket being sized to receive said upper vertical end of said anchor stud, said upper socket having a cross-sectional shape corresponding to said openings in said mounting members;

an elongated mast having an upper and lower end thereon, said mast having a cross-sectional shape corresponding to the cross-sectional shape of said openings in said mounting members and said upper socket in said coupling member;

said mast being insertable between said first and second fence sections and between said third and fourth fence sections through said registered openings in said mounting members thereof and into said upper socket in said coupling member to thereby support said first and second fence sections and said third and fourth fence sections in next adjacency to each other and in said X pattern when viewed from above.

23. A fence arrangement according to claim 21 further comprising a spacer member disposed on said post intermediate said first and second tier of mated fence sections.

24. A fence arrangement according to claim 22 further comprising a spacer member disposed on said post intermediate said first and second tiers of fence sections.

25. A fence arrangement according to claim 24 further comprising:

a second upstanding post having a hinge support surface thereon, said second post being insertable through said opening in said second mounting member of said first fence section and said first mounting member of said third fence section;

a lower hinge support having a mating surface thereon, a mast-receiving opening therein and a hinge post extending therefrom, said lower hinge support being receivable on said hinge support surface on said second upstanding post such that said mating surface on said lower hinge support is contacted against said second mating surface on said second mounting member of said first fence section;

a spacer disposed on said second upstanding post intermediate said first and said third fence sections;

an upper hinge support having a mating surface thereon, a mast-receiving opening therein and a hinge post extending therefrom, said upper hinge support being receivable on said spacer such that said mating surface on said upper hinge support is contacted against said first mating surface on said third fence section; and, a gate member swingably mounted on said hinge posts.

* * * * *

UNITED STATES PATENT AND TRADEMARK OFFICE

CERTIFICATE OF CORRECTION

PATENT NO. : 4,174,096

DATED : November 13, 1979

INVENTOR(S) : David Campbell

It is certified that error appears in the above-identified patent and that said Letters Patent are hereby corrected as shown below:

Column 5, line 20, "axes central" should read --central axes--;

line 23, "axes central" should read --central axes--;

line 36, "axes central" should read --central axes--;

line 40, "axes central" should read --central axes--;

line 41 "axes central" should read --central axes--;

Column 6, line 31, "adpated" should read --adapted--.

Signed and Sealed this

Twelfth Day of February 1980

[SEAL]

Attest:

SIDNEY A. DIAMOND

Attesting Officer

Commissioner of Patents and Trademarks